US010286366B2

(12) United States Patent
Govyadinov et al.

(10) Patent No.: US 10,286,366 B2
(45) Date of Patent: May 14, 2019

(54) MICROFLUIDIC MIXING DEVICE

(71) Applicant: Hewlett-Packard Development Company, L.P., Houston, TX (US)

(72) Inventors: Alexander Govyadinov, Corvallis, OR (US); Erik D. Torniainen, Corvallis, OR (US); David P. Markel, Corvallis, OR (US); Pavel Kornilovich, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 472 days.

(21) Appl. No.: 14/407,005

(22) PCT Filed: Sep. 24, 2012

(86) PCT No.: PCT/US2012/056915

§ 371 (c)(1),
(2) Date: Dec. 10, 2014

(87) PCT Pub. No.: WO2014/046687

PCT Pub. Date: Mar. 27, 2014

(65) Prior Publication Data

US 2015/0190767 A1 Jul. 9, 2015

(51) Int. Cl.

| | |
|---|---|
| ***B01F 5/12*** | (2006.01) |
| ***B01F 11/00*** | (2006.01) |
| ***B01F 13/00*** | (2006.01) |
| ***B01F 15/00*** | (2006.01) |
| ***B01L 3/00*** | (2006.01) |

(52) U.S. Cl.

CPC ..... *B01F 5/12* (2013.01); *B01F 11/0071* (2013.01); *B01F 13/0059* (2013.01); *B01F 15/00493* (2013.01); *B01L 3/50273* (2013.01); *B01L 2300/0867* (2013.01); *B01L 2300/0883* (2013.01); *B01L 2400/0433* (2013.01);

(Continued)

(58) Field of Classification Search

CPC ..... B01F 11/0071; B01F 5/12; B01F 13/0059
USPC ..... 366/116, 127
See application file for complete search history.

(56) References Cited

U.S. PATENT DOCUMENTS

| | | | | |
|---|---|---|---|---|
| 7,708,873 | B2 | 5/2010 | Bazant et al. | |
| 7,992,591 | B2 * | 8/2011 | Delamarche | B01F 5/0611 137/831 |

(Continued)

FOREIGN PATENT DOCUMENTS

| | | |
|---|---|---|
| CN | 1755370 | 4/2006 |
| JP | H05-301038 | 11/1993 |

(Continued)

OTHER PUBLICATIONS

International Searching Authority, "International Search Report," issued in connection with PCT Application Serial No. PCT/US2012/056915, dated Apr. 25, 2013, 6 pages.

(Continued)

*Primary Examiner* — David L Sorkin
(74) *Attorney, Agent, or Firm* — Dhand Law PC

(57) ABSTRACT

In one embodiment, a microfluidic mixing device includes a mixing channel, a fluid inlet chamber to pass fluids into the mixing channel, an axis-asymmetric mixing actuator integrated within the channel to cause fluid displacements that mix the fluids as they flow through the channel, and an outlet chamber to receive the mixed fluids.

11 Claims, 5 Drawing Sheets

(52) U.S. Cl.
CPC ..... *B01L 2400/0442* (2013.01); *B01L 2400/0487* (2013.01)

(56) References Cited

U.S. PATENT DOCUMENTS

| | | | | |
|---|---|---|---|---|
| 2002/0083771 | A1 | 7/2002 | Khuri-Yakub et al. | |
| 2003/0107946 | A1* | 6/2003 | Cosby | B01F 11/0045 366/127 |
| 2003/0210607 | A1* | 11/2003 | Gilbert | B01F 3/088 366/152.1 |
| 2004/0066703 | A1* | 4/2004 | Sparey-Taylor | B01F 11/0241 366/127 |
| 2004/0257906 | A1* | 12/2004 | Scriba | B01F 11/0266 506/43 |
| 2006/0073075 | A1 | 4/2006 | Nagaoka et al. | |
| 2009/0074621 | A1 | 3/2009 | Murakami | |
| 2010/0039887 | A1* | 2/2010 | Van Den Bijgaart | B01F 11/0045 366/275 |
| 2010/0212762 | A1 | 8/2010 | Den Toonder et al. | |
| 2011/0286493 | A1 | 11/2011 | Torniainen et al. | |
| 2012/0046639 | A1 | 2/2012 | Hansen et al. | |

FOREIGN PATENT DOCUMENTS

| | | |
|---|---|---|
| JP | 2003-516129 | 5/2003 |
| JP | 2004-354180 | 12/2004 |
| JP | 2006-105638 | 4/2006 |
| JP | 2007-010676 | 1/2007 |
| JP | 2007-248298 | 9/2007 |
| JP | 2010-521285 | 6/2010 |
| JP | 2011104483 | 6/2011 |
| KR | 1020020097093 | 12/2002 |
| KR | 1020090106089 | 12/2009 |
| WO | WO-0132930 | 5/2001 |
| WO | WO-2008110975 | 9/2008 |
| WO | WO-2008139378 | 11/2008 |
| WO | WO-2008139401 | 11/2008 |
| WO | 2009118689 | 10/2009 |
| WO | WO-2010100732 | 9/2010 |
| WO | 2011146145 | 11/2011 |
| WO | WO-2011146156 | 11/2011 |
| WO | WO-2012044154 | 4/2012 |

OTHER PUBLICATIONS

International Searching Authority, "Written Opinion," issued in connection with PCT Application Serial No. PCT/US2012/056915, dated Apr. 25, 2013, 5 pages.

Supplemental European Search Report and Opinion, dated Jan. 18, 2016, EP Patent Application No. 12884809.0, 8 pages.

Wang, S. S., et al. "Acoustically induced bubbles in a microfluidic channel for mixing enhancement." Jun. 23, 2008, Microfluidics and Nanofluidics vol. 6. No. 6, pp. 847-852.

* cited by examiner

MICROFLUIDIC MIXING DEVICE

BACKGROUND

The ability to mix fluids at microscale is valuable to a variety of industries, such as the food, biological, pharmaceutical, and chemical industries. One area of development in microscale fluidic mixing is with microfluidic mixing devices. Microfluidic mixing devices are used within these industries for purposes such as biomedical diagnostics, drug development, DNA replication, and so on. Microfluidic mixing devices provide miniaturized environments that facilitate the mixing of very small sample volumes. Microfabrication techniques enable the fabrication of small-scale microfluidic mixing devices on a chip. Enhancing the efficiency of such microfluidic mixing devices is beneficial for increasing the throughput and reducing the cost of various microfluidic systems, such as lab-on-chip systems. Accordingly, efforts to improve the mixing performance and reduce the size of microfluidic mixing devices are ongoing.

BRIEF DESCRIPTION OF THE DRAWINGS

The present embodiments will now be described, by way of example, with reference to the accompanying drawings, in which.

DETAILED DESCRIPTION

Overview

Figure 1:
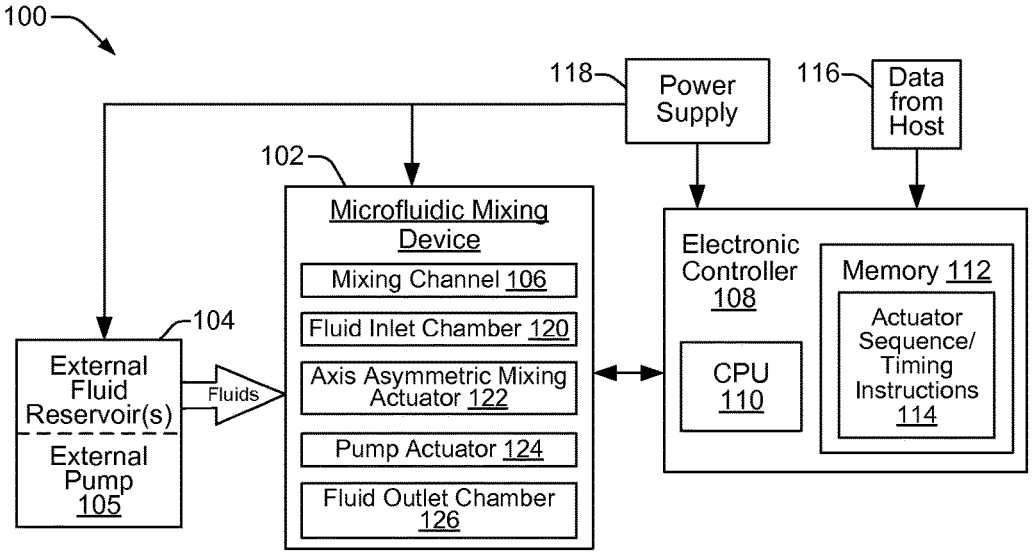
FIG. 1 shows a microfluidic mixing system suitable for implementing a microfluidic mixing device and controller-implemented mixing methods, according to an embodiment.

As noted above, microfluidic mixing devices play an important role in various industries, such as the food, biological, pharmaceutical, and chemical industries. Accordingly, numerous microfluidic mixing devices have been previously developed, with the general goal of improving the mixing performance while reducing the space used to achieve the mixing result. However, because microfluidic mixing devices operate in a laminar flow regime, most devices rely on diffusive species mixing. Diffusive mixing is slow and relies on nonzero diffusivity of the mixing components, and generally requires long mixing periods with large fluidic paths and volumes.

For example, passive mixing devices typically provide increased contact areas and contact times between the components being mixed. Most passive mixers have complicated three dimensional geometries, occupy large areas of the microfluidic system, are difficult to fabricate, and have large associated pressure losses across the mixing element and microfluidic system. Such mixers also generally use large volumes of mixing fluids which results in considerable dead/parasitic volumes within the microfluidic system.

Active mixing devices improve mixing performance by providing forces that speed up the diffusion process between the components being mixed. Active mixing devices usually employ a mechanical transducer that agitates the fluid components to improve mixing. Some examples of transducers used in active mixers include acoustic or ultrasonic, dielectrophoretic, electrokinetic time-pulse, pressure perturbation, and magnetic transducers. In general, active mixing devices that implement such transducers can be expensive and difficult to fabricate.

Embodiments of the present disclosure provide an active microfluidic mixing device and controller-implemented mixing methods for a microfluidic mixing system that enable significant increases in mixing efficiency over conventional microfluidic mixing by diffusion. One or more inertial pumps located asymmetrically about the center axis of a fluidic channel (i.e., located axially asymmetrically within the fluidic channel) can be activated to deflect fluid as it passes over the pump(s). Activation of one inertial pump, or the alternating activation of a number of inertial pumps, disrupts normal fluid flow paths within the channel and causes fluids to follow a wiggling path that significantly increases the mixing of the fluids as they flow through the channel. A microfluidic mixing device includes a fluidic mixing channel with one or more fluidic inputs, and at least one inertial pump actuator (e.g., a thermal resistor) located axially asymmetrically within the channel to create a disrupted, wiggled, fluid flow. The microfluidic mixing device can include a pair of axis-asymmetrical actuators placed a uniform distance from the channel input, or placed at staggered distances from the channel input. The microfluidic mixing device can include an odd number of axis-asymmetrical actuators placed at uniform and/or staggered distances from the channel input. Among one or more axis-asymmetric actuators, a microfluidic mixing device can include a pump actuator located symmetrically about the center axis of the fluidic channel to pump fluid through the channel. A controller controls the sequence and timing of activation of all the actuators in a microfluidic mixing device to achieve efficient fluid mixing and/or fluid pumping.

In one implementation, a microfluidic mixing device includes a mixing channel, a fluid inlet chamber to pass fluids into the mixing channel, an axis-asymmetric mixing actuator integrated within the channel to cause fluid displacements that mix the fluids as they flow through the channel, and an outlet chamber to receive the mixed fluids.

In another implementation, a microfluidic mixing system includes a microfluidic mixing device comprising a fluid mixing channel. The system includes a fluid pump to pump the fluids through the channel. In different implementations, the fluid pump is an external pump and/or an inertial pump integrated within the fluid mixing channel. The system also includes axis-asymmetric mixing actuators integrated within the channel to mix fluids as they flow through the channel.

In another implementation, a non-transitory processor-readable medium stores instructions that when executed by a processor cause the processor to activate a pump that pumps at least two different fluids through a microfluidic mixing channel. The instructions further cause the processor to alternately activate at least one axis-asymmetric mixing actuator within the microfluidic mixing channel alternately to cause fluid displacements that mix the at least two different fluids as they pass through the microfluidic mixing channel.

ILLUSTRATIVE EMBODIMENTS

FIG. 1 shows a microfluidic mixing system 100 suitable for implementing a microfluidic mixing device and controller-implemented mixing methods, as generally disclosed herein, according to an embodiment of the disclosure. The example microfluidic mixing system 100 includes a microfluidic mixing device 102, and external fluid reservoirs 104 to supply fluidic components/samples and/or solutions to the mixing device 102 for mixing. In some implementations, the microfluidic mixing system 100 may include an external pump 105 as part of the external fluid reservoirs 104, or as a stand-alone pump 105. The microfluidic mixing device 102 can be implemented as a chip-based mixing device that includes a microfluidic mixing channel 106 for mixing two or more fluids as they flow through the channel 106, and/or for mixing pigments or particles within a single host fluid as the host fluid flows through the channel 106. In general, the structures and components of the chip-based microfluidic mixing device 102 can be fabricated using conventional integrated circuit microfabrication techniques such as electroforming, laser ablation, anisotropic etching, sputtering, dry and wet etching, photolithography, casting, molding, stamping, machining, spin coating, laminating, and so on.

The microfluidic mixing system 100 also includes an electronic controller 108 to control various components and functions of the system 100, such as microfluidic mixing device 102, the external fluid reservoir(s) 104, and the external pump 105. In one example, controller 108 controls various functions of the microfluidic mixing device 102 that include the sequence and timing of activation for actuators within the mixing device 102 to mix fluid within the mixing device 102 and to move fluid through the mixing device 102. Controller 108 typically includes a processor (CPU) 110, one or more memory components 112 including volatile and non-volatile memory components, firmware and/or software components stored in memory 112 comprising instructions that are readable and executable by processor 110, and other electronics for communicating with and controlling components and functions of microfluidic mixing device 102, external fluid reservoir(s) 104, external pump 105, and other components of microfluidic mixing system 100. Accordingly, electronic controller 108 comprises a programmable device that includes machine-readable instructions stored in the form of one or more software modules, for example, on a non-transitory processor/computer-readable medium such as memory 112, and executable on a processor 110 to control mixing and pumping processes on the microfluidic mixing device 102. Such modules may include, for example, the actuator sequence and timing instruction module 114, as shown in the example implementation of FIG. 1.

In some implementations, electronic controller 108 may receive data 116 from a host system, such as a computer, and temporarily store the data 116 in a memory 112. Typically, data 116 is sent to microfluidic mixing system 100 along an electronic, infrared, optical, or other information transfer path. Data 116 represents, for example, executable instructions and/or parameters for use alone or in conjunction with other executable instructions in software/firmware modules stored in memory 112 of electronic controller 108 to control fluid flow, fluid mixing, and other fluid mixing related functions within microfluidic mixing device 102. For example, various software and data 116 executable on processor 110 of controller 108 enable selective and controlled activation of micro-inertial actuators within microfluidic mixing device 102 through precise control over the sequence, timing, frequency and duration of fluid displacements generated by the actuators. Readily modifiable (i.e., programmable) control over such actuators through data 116 and/or the actuator sequence/timing instructions 114 that are executable on processor 110, enables any number of different mixing process protocols to be performed on different implementations of a microfluidic mixing device 102 within a microfluidic mixing system 100. Mixing protocols can be readily adjusted, on-the-fly, for a given microfluidic mixing device 102.

Microfluidic mixing system 100 also typically includes one or more power supplies 118 to provide power to the microfluidic mixing device 102, electronic controller 108, external fluidic reservoirs 104, external pump 105, and other electrical components that may be part of the system 100.

Figure 2:
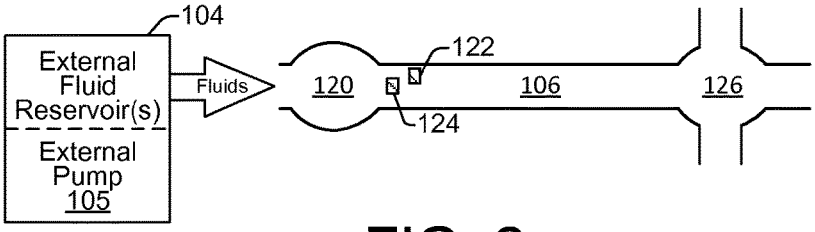
FIG. 2 shows an example of a microfluidic mixing device suitable for use within a microfluidic mixing system, according to an embodiment.
Figure 3:
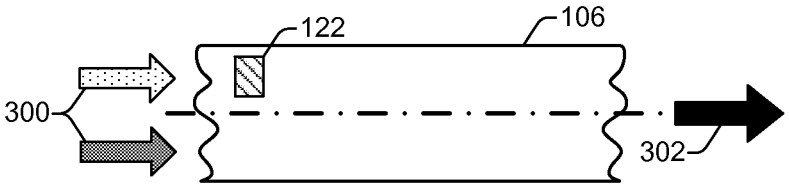
FIGS. 3-15 show various implementations of microfluidic mixing channels comprising varying configurations of axis-asymmetric mixing actuators and pump actuators, according to embodiments.

FIG. 2 shows an example of a microfluidic mixing device 102 suitable for use within a microfluidic mixing system 100, according to an embodiment. As noted above, the microfluidic mixing device 102 includes a microfluidic mixing channel 106 for mixing fluids (e.g., two or more fluids, or pigments and/or particles in a single host fluid) as the fluids flow through the channel 106. While the shape of the microfluidic mixing channel 106 is shown generally throughout this disclosure as being straight, this is not intended as a limitation on the shape of the channel 106. Thus, the shape of channel 106 can include other shapes such as curved shapes, snake-like shapes, shapes with 90 degree corners, combinations thereof, and so on. Fluids entering the channel 106 are typically supplied by one or more external fluid reservoirs 104, and they pass into channel 106 from a fluid inlet chamber 120. The number of different fluids entering channel 106 through fluid inlet chamber 120 for mixing is typically two, but in other implementations there may be three or more different fluids in the inlet chamber 120 that enter channel 106 for mixing. In other implementations, the fluid may be a single host fluid containing pigments and/or particles.

Referring now to FIGS. 1 and 2, a fluid inlet chamber 120 may be fluidically coupled to external fluid reservoirs 104 to receive fluids before the fluids flow into microfluidic mixing channel 106. In some implementations, however, other methods of providing fluids to a fluid inlet chamber 120 are contemplated. For example, fluids may enter a fluid inlet chamber 120 by other means, such as through one or more other fluidic channels coupled to the inlet chamber 120.

The illustration of the fluid inlet chamber 120 in FIG. 2 is intended to indicate that the fluid inlet chamber 120 has a larger width and volume than the width and volume of the entrance to the microfluidic mixing channel 106. The width and volume difference enables a pumping effect from an inertial pump actuator located toward one end of the channel 106, such as pump actuator 124. In some implementations, fluid is pumped through channel 106 and into a fluid outlet chamber 126 using one or more fluidic pump actuators 124, instead of, or in addition to, an external pump 105. A fluidic pump actuator 124 located toward one end of a microfluidic mixing channel 106 can generate a unidirectional fluid flow through the channel 106 toward the opposite end of the channel 106. A fluid outlet chamber 126 can be implemented in various ways, such as a reservoir, as another fluidic channel, as a reservoir with one or more coupled fluidic channels, and so on.

Referring still to FIGS. 1 and 2, the microfluidic mixing channel 106 of microfluidic mixing device 102 also includes one or more axis-asymmetric mixing actuators 122. As shown in FIG. 2, an axis-asymmetric mixing actuator 122 is a fluidic inertial pump actuator that is integrated within the mixing channel 106 at a location that is on one side or the other of the center line, or center axis, that runs the length of the mixing channel 106. Therefore, an axis-asymmetric mixing actuator 122 can be located anywhere along the length of the mixing channel 106, but will be located asymmetrically with respect to the channel's center axis. While a greater mixing effect can be achieved by locating axis-asymmetric mixing actuators 122 toward the entrance of the mixing channel 106 (i.e., where the fluidic components first enter the channel 106), the axis-asymmetric mixing actuators 122 are not limited to placement toward the entrance to the mixing channel 106.

Mixing actuators 122 and pump actuators 124 can be implemented as any of a variety of fluidic inertial pump type actuators. For example, actuators 122 and 124 can be implemented as thermal resistors that produce steam bubbles to create fluid displacement within the mixing channel 106. Actuators 122 and 124 can also be implemented as piezo elements (PZT) whose electrically induced deflections generate fluid displacements within the mixing channel 106. Other deflective membrane elements activated by electrical, magnetic, mechanical, and other forces, are also possible for use in implementing actuators 122 and 124.

FIGS. 3-15 show various implementations of microfluidic mixing channels 106 comprising varying configurations of axis-asymmetric mixing actuators 122 and pump actuators 124, according to embodiments of the disclosure. While numerous configurations are illustrated and discussed with regard to FIGS. 3-15, these configurations do not provide an exhaustive account of all possible configurations. Therefore, it should be evident that other configurations are possible and are contemplated by this disclosure. In addition, while the actuators are generally illustrated in FIGS. 3-15 as being of a uniform size, various other actuators are contemplated having non-uniform sizes. In FIGS. 3-15, fluids 300 (e.g., two or more different fluids, or a single host fluid containing pigments and/or particles for mixing) entering the mixing channel 106 are indicated by the two differently shaded arrows to the left, while a resultant mixed fluid 302 exiting the mixing channel 106 is indicated by the single dark shaded arrow to the right.

In general, the axis-asymmetric mixing actuators 122 within the mixing channel 106 provide active microfluidic mixing through the controlled activation of one or more mixing actuators 122. As noted above, controller 108 provides such control through various software and data 116 instructions executable on processor 110 to enable selective and controlled activation of the inertial actuators. The microfluidic mixing device 102 achieves a mixing effect in the fluids passing through mixing channel 106 by controlling one or more actuators 122 in an alternating sequence of activation. More specifically, as fluids pass over axis-asymmetric mixing actuators 122, the alternating activation of the actuators 122 generates fluid displacements that create a wiggling fluid flow path. The wiggling fluid flow path causes the fluids to mix with a mixing efficiency that far exceeds that of conventional mixing by diffusion.

Figure 4:
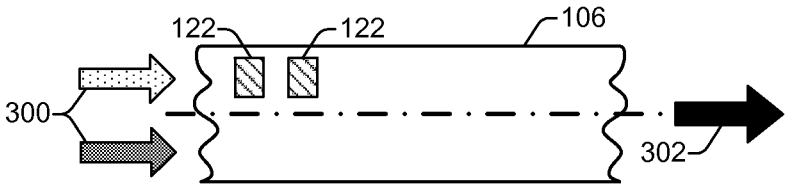

Among the numerous possible actuator configurations shown in FIGS. 3-15, there are an equal or greater number of alternating activation sequences or mixing protocols that can be applied. The alternating sequences of activation may or may not include a time delay between different successive activations. For example, referring to FIG. 3, the mixing channel 106 includes a single axis-asymmetric mixing actuator 122. In this implementation, an alternating sequence of activation can include an activation of the mixing actuator 122, followed by a time delay, followed by another activation of the actuator 122, and so on. The activation of an actuator 122 typically lasts for a predetermined time duration that can be adjusted and programmably controlled by controller 108, as generally noted above. In FIG. 4, the mixing channel 106 includes two axis-asymmetric mixing actuators 122 on the same side of the channel and staggered along the length of the channel. In this implementation, an alternating sequence of activation can include an activation of a first actuator which lasts for a preset time duration, followed immediately by an activation of the second actuator which lasts for a preset time duration, followed immediately thereafter by another activation of the first actuator, and so on. The activation of the two actuators alternates such that the two actuators are not activated simultaneously. During the activation time of the first actuator, the second actuator is idle. The second actuator is then activated directly after the completion of the activation time of the first actuator, with no time delay between when the first actuator activation ends, and when the second actuator activation begins. Therefore, in such an alternating sequence of activation, there is no time delay between successive activations of the two mixing actuators 122. However, in the FIG. 4 implementation, a different alternating sequence of activation can also include an activation of a first actuator for a preset time duration, followed by a time delay, followed by an activation of the second actuator for a preset time duration, followed by a time delay, followed by another activation of the first actuator, and so on. The two actuators are activated in turn, one after the other (i.e., not simultaneously), and a time delay is inserted in between the end of one activation and the beginning of a next activation. Therefore, in such a different alternating sequence of activation, there are time delays between successive activations of the mixing actuators 122.

Figure 5:
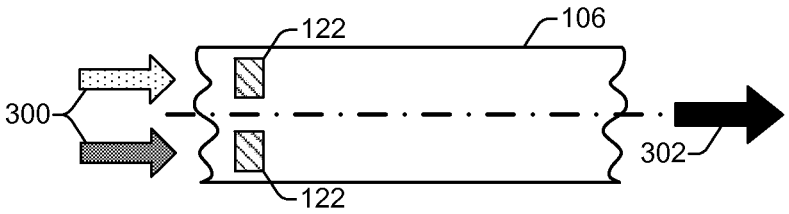
Figure 6:
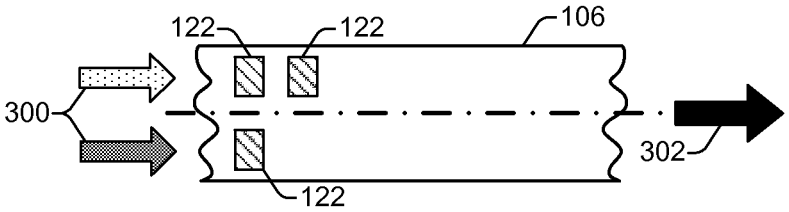

FIG. 5 shows an implementation of a microfluidic mixing channel 106 in which there are two axis-asymmetric mixing actuators 122 on different sides of the channel 106. In this implementation, the actuators 122 are not staggered along the length of the channel 106, but instead are symmetric or co-located with respect to the length of the channel. An alternating sequence of activation can include, among other protocols, an alternating activation of the two actuators 122 with or without time delays in between the activations. FIG. 6 shows an implementation of a microfluidic mixing channel 106 in which there are two axis-asymmetric mixing actuators 122 on the same side of the channel and staggered along the length of the channel, in addition to one axis-asymmetric mixing actuator 122 on the opposite side of the channel and symmetric or co-located along the length of the channel with respect to one of the actuators on the opposite side of the channel. An alternating sequence of activation can include, among other protocols, an alternating activation of the three actuators 122 with or without time delays in between the activations.

Figure 7:
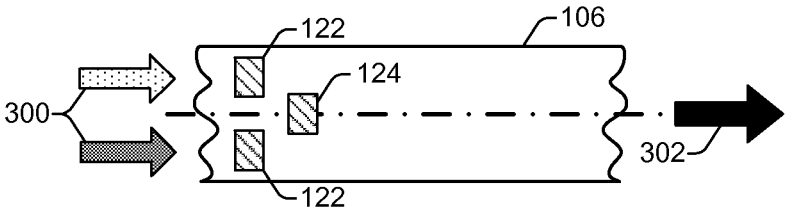
Figure 8:
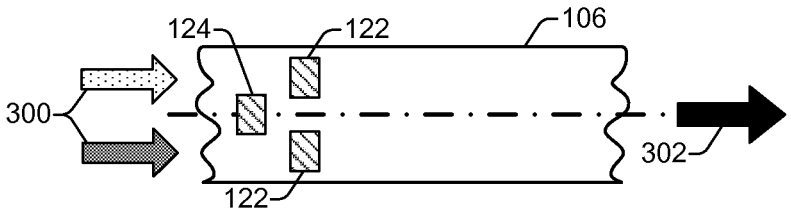

FIG. 7 shows an implementation of a microfluidic mixing channel 106 in which there are two axis-asymmetric mixing actuators 122 on different sides of the channel 106. In this implementation, the actuators 122 are not staggered along the length of the channel 106, but instead are symmetric or co-located with respect to the length of the channel. An alternating sequence of activation can include, among other protocols, an alternating activation of the two actuators 122 with or without time delays in between the activations. In addition to mixing actuators 122, the FIG. 7 implementation includes a pump actuator 124 located symmetrically on the center axis of the channel 106. The pump actuator 124 is located toward one end of a microfluidic mixing channel 106 and can be activated to provide a fluidic pumping effect that generates a unidirectional fluid flow through the channel 106 (e.g., from left to right). A microfluidic mixing channel 106 can include one or more pump actuators 124 instead of, or in addition to, an external pump 105 to provide a fluidic pumping effect to move fluid through the channel. FIG. 8 shows an implementation of a microfluidic mixing channel 106 that is similar to that of FIG. 7, in that there are two axis-asymmetric mixing actuators 122 on different sides of the channel 106 that are co-located with respect to the length of the channel, in addition to a pump actuator 124 located symmetrically on the center axis of the channel 106. In the FIG. 8 implementation, however, the location of the mixing actuators 122 and the pump actuator 124 with respect to the input end along the length of the channel is reversed.

Figure 9:
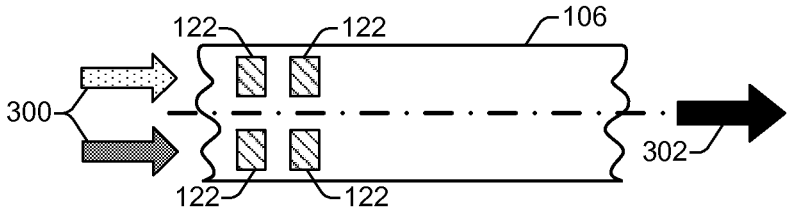
Figure 10:
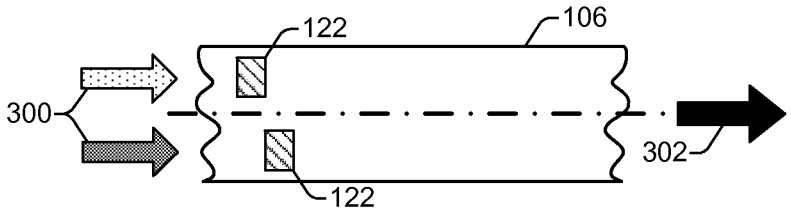
Figure 11:
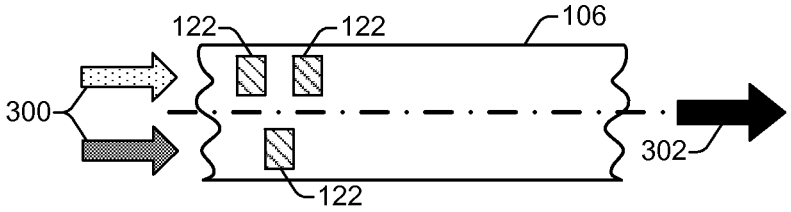

FIG. 9 shows an implementation of a microfluidic mixing channel 106 in which there are two pairs of axis-asymmetric mixing actuators 122, each pair having an actuator on opposite sides of the channel 106. Each pair of actuators has an actuator on different sides of the channel 106. In this implementation, the pairs of actuators 122 are staggered along the length of the channel 106. An alternating sequence of activation can include, among other protocols, an alternating activation of the four actuators 122 in different sequences and with or without time delays in between the activations. FIG. 10 shows an implementation of a microfluidic mixing channel 106 in which there are two axis-asymmetric mixing actuators 122 on different sides of the channel 106 that are staggered along the length of the channel 106. FIG. 11 shows an implementation of a microfluidic mixing channel 106 in which there are two axis-asymmetric mixing actuators 122 on the same side of the channel and staggered along the length of the channel, in addition to one axis-asymmetric mixing actuator 122 on the opposite side of the channel that is not symmetric or co-located along the length of the channel with respect to either of the actuators on the opposite side of the channel.

Figure 12:
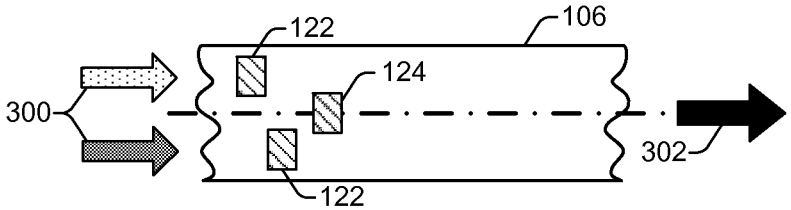
Figure 13:
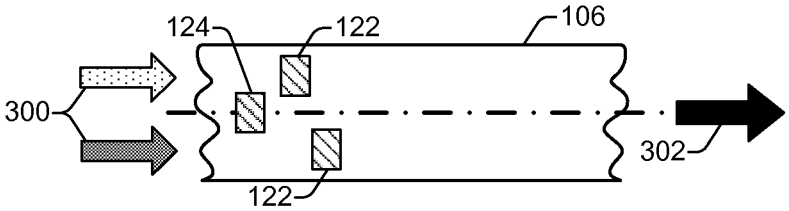
Figure 14:
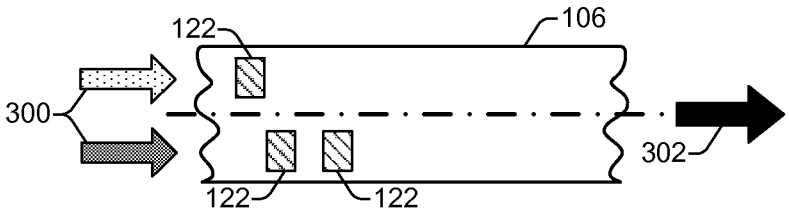
Figure 15:
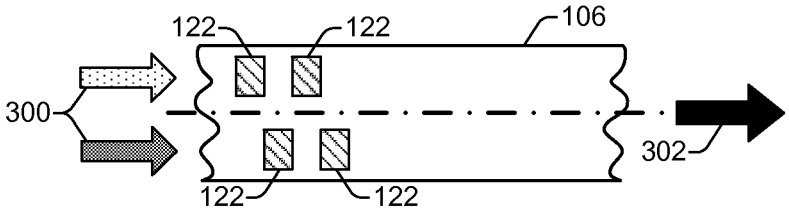

FIG. 12 shows an implementation of a microfluidic mixing channel 106 in which there are two axis-asymmetric mixing actuators 122 on different sides of the channel 106 that are staggered along the length of the channel 106, in addition to a pump actuator 124 located symmetrically on the center axis of the channel 106. Like FIG. 12, FIG. 13 shows an implementation of a microfluidic mixing channel 106 in which there are two axis-asymmetric mixing actuators 122 on different sides of the channel 106 that are staggered along the length of the channel 106, in addition to a pump actuator 124 located symmetrically on the center axis of the channel 106. However, in FIG. 13, the location of the mixing actuators 122 and the pump actuator 124 with respect to the input end along the length of the channel is reversed. FIG. 14 shows another implementation of a microfluidic mixing channel 106 in which there are two axis-asymmetric mixing actuators 122 on the same side of the channel and staggered along the length of the channel, in addition to one axis-asymmetric mixing actuator 122 on the opposite side of the channel that is not symmetric or co-located along the length of the channel with respect to either of the actuators on the opposite side of the channel. FIG. 15 shows an implementation of a microfluidic mixing channel 106 in which there are two axis-asymmetric mixing actuators 122 on the same side of the channel and staggered along the length of the channel, in addition to two axis-asymmetric mixing actuators 122 on the opposite side of the channel that are also staggered along the length of the channel. None of the actuators 122 are symmetric or co-located with one another along the length of the channel.

Figure 16:
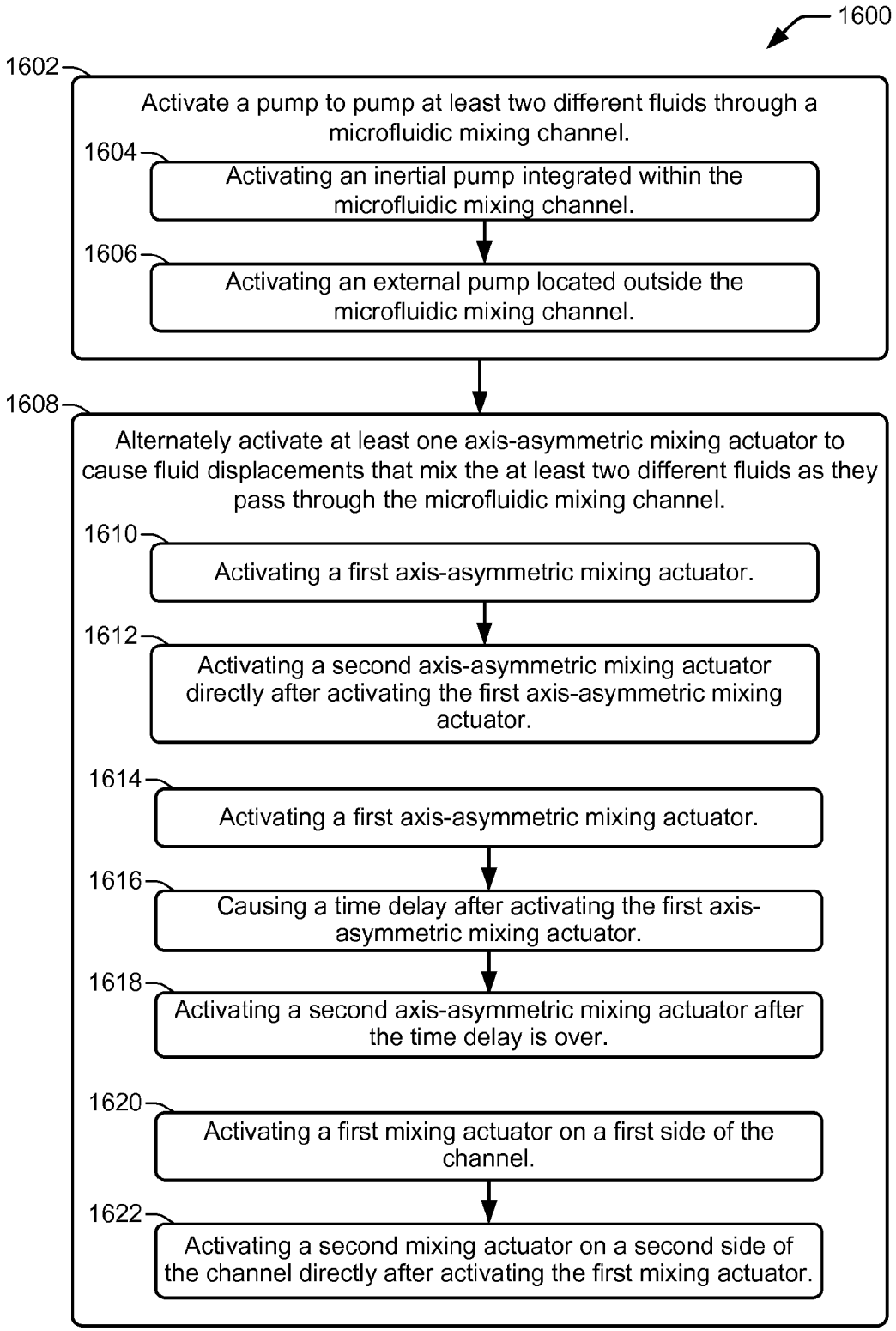
FIG. 16 shows an example microfluidic mixing method, according to an embodiment.

FIG. 16 shows an example microfluidic mixing method 1600, according to an embodiment of the disclosure. Method 1600 is associated with the embodiments discussed above with regard to FIGS. 1-15, and details of the steps shown in method 1600, can be found in the related discussion of such embodiments. The steps of method 1600 may be embodied as programming instructions stored on a non-transitory computer/processor-readable medium, such as a memory 112 on the controller 108 of FIG. 1. In an embodiment, the implementation of the steps of method 1600 is achieved by the reading and execution of such programming instructions by a processor, such as processor 110 FIG. 1. Method 1600 may include more than one implementation, and different implementations of method 1600 may not employ every step presented in the illustrated flowchart. Therefore, while steps of method 1600 are presented in a particular order within the flowchart, the order of their presentation is not intended to be a limitation as to the order in which the steps may actually be implemented, or as to whether all of the steps may be implemented. For example, one implementation of method 1600 might be achieved through the performance of a number of initial steps, without performing one or more subsequent steps, while another implementation of method 1600 might be achieved through the performance of all of the steps.

Referring to FIG. 16, method 1600 begins at block 1602 with activating a pump to pump at least two different fluids through a microfluidic mixing channel. In different implementations, activating the pump can include activating an inertial pump (e.g., a thermal resistor bubble pump) that is integrated within the microfluidic mixing channel or activating an external pump located outside the microfluidic mixing channel, as shown at blocks 1604 and 1606, respectively.

At block 1608, the method 1600 continues with alternately activating at least one axis-asymmetric mixing actuator within the microfluidic mixing channel. Alternately activating at least one axis-asymmetric mixing actuator causes fluid displacements within the microfluidic mixing channel that mix the fluids as they pass through the channel. In one implementation, alternately activating at least one axis-asymmetric mixing actuator includes activating a first axis-asymmetric mixing actuator, and then activating a second axis-asymmetric mixing actuator directly after activating the first axis-asymmetric mixing actuator, as shown at blocks 1610 and 1612, respectively. In another implementation, alternately activating at least one axis-asymmetric mixing actuator includes activating a first axis-asymmetric mixing actuator, then causing a time delay after activating the first axis-asymmetric mixing actuator, followed by activating a second axis-asymmetric mixing actuator after the time delay is over, as shown at blocks 1614, 1616, and 1618, respectively. In another implementation, alternately activating at least one axis-asymmetric mixing actuator includes activating a first mixing actuator on a first side of the channel, and activating a second mixing actuator on a second side of the channel directly after activating the first mixing actuator, as shown at blocks 1620 and 1622. In other implementations, time delays can be employed between the activations of actuators located on either side of the mixing channel and/or located on the same side of the mixing channel.

What is claimed is:

1. A microfluidic mixing device comprising:

a mixing channel;

a fluid inlet chamber to pass fluids into the mixing channel, the mixing channel having a unidirectional fluid flow therethrough;

a pump actuator located symmetrically on a center axis of the mixing channel;

an axis-asymmetric mixing actuator integrated within the mixing channel to cause fluid displacements that mix the fluids as they flow through the mixing channel, the axis-asymmetric mixing actuator including at least two resistors to produce steam bubbles when activated;

an outlet chamber to receive the mixed fluids; and a controller to alternatingly activate the at least two resistors to generate fluid displacements with the steam bubbles to create a wiggling fluid path through the mixing channel, wherein the pump actuator causes a fluid flow through the mixing channel in a direction from the fluid inlet chamber to the outlet chamber.

2. A microfluidic mixing device as in claim 1, wherein a width of the fluid inlet chamber is larger than a width of an entrance to the mixing channel.

3. A microfluidic mixing device as in claim 1, wherein the axis-asymmetric mixing actuator comprises the at least two resistors located on a first side of the mixing channel and staggered along a length of the mixing channel.

4. A microfluidic mixing device as in claim 1, wherein the at least two resistors include a first resistor on a first side of the mixing channel and a second resistor on an opposite side of the mixing channel and co-located along the length of the mixing channel with respect to the first resistor.

5. A microfluidic mixing device as in claim 3, further comprising a resistor on an opposite side of the mixing channel and staggered along the length of the mixing channel with respect to the at least two resistors located on a first side of the mixing channel.

6. A microfluidic mixing device as in claim 1, wherein the axis-asymmetric mixing actuator comprises the at least two resistors being on different sides of the mixing channel and co-located along the length of the mixing channel.

7. A microfluidic mixing device as in claim 1, wherein the axis-asymmetric mixing actuator comprises the at least two resistors being on different sides of the mixing channel and staggered along the length of the mixing channel.

8. A microfluidic mixing system comprising:

a microfluidic mixing device comprising a fluid mixing channel;

a fluid pump to pump fluids through the mixing channel;

axis-asymmetric mixing actuators integrated within the mixing channel to mix fluids as they flow through the mixing channel, at least one of the axis-asymmetric mixing actuators including at least two resistors to produce steam bubbles when activated; and a controller coupled to the axis asymmetric mixing actuators, the controller being to:

alternatively activate the at least two resistors to generate fluid displacements with the steam bubbles to create a wiggling fluid path through the mixing channel.

9. A microfluidic mixing system as in claim 8, wherein the fluid pump is selected from the group consisting of an external fluid pump and a pump actuator integrated within the mixing channel at a center axis of the mixing channel and toward one end of the mixing channel.

10. A microfluidic mixing system as in claim 8, further comprising a controller to control a sequence and a timing of activations of the at least two resistors.

11. The microfluidic mixing device as in claim 4, wherein the controller is to alternatingly activate the axis-asymmetric mixing actuator by activating the first resistor for a preset time duration followed by an activation of the second resistor for another preset time duration.

* * * * *